United States Patent [19]

Smith

[11] 4,275,831

[45] Jun. 30, 1981

[54] MAKE UP AIR SYSTEM

[75] Inventor: Jeffrey O. Smith, Birmingham, Mich.

[73] Assignee: SBS Corporation, Rochester, Mich.

[21] Appl. No.: 972,775

[22] Filed: Dec. 26, 1978

[51] Int. Cl.[3] ..... G05D 23/00

[52] U.S. Cl. ..... 237/2 R; 237/46; 165/39; 165/DIG. 2; 165/DIG. 12

[58] Field of Search ..... 237/46, 2 R, 8 R; 165/DIG. 12, 39, DIG. 2; 34/86; 62/238 E, 428, 507

[56] References Cited

U.S. PATENT DOCUMENTS

| | | | |
|---|---|---|---|
| 576,718 | 2/1897 | Bolton | 237/46 X |
| 1,637,276 | 7/1927 | Forgan-Potts | 237/46 |
| 2,189,895 | 2/1940 | Grutzner | 237/12.1 |
| 2,296,946 | 9/1942 | Olstad et al. | 165/39 |
| 3,768,546 | 10/1973 | Shipes | 165/39 |
| 4,067,382 | 1/1978 | English | 165/DIG. 2 |
| 4,084,635 | 4/1978 | Marshall | 165/DIG. 2 |
| 4,084,745 | 4/1978 | Jones | 165/DIG. 2 |

*Primary Examiner*—Larry I. Schwartz
*Assistant Examiner*—Henry Bennett
*Attorney, Agent, or Firm*—Harness, Dickey & Pierce

[57] ABSTRACT

A system for air cooling a fluid which has been heated through use in an industrial process in a plant and utilizing the air used for cooling, which has now been heated, for providing heated, make up air within a desired temperature range to that plant.

6 Claims, 3 Drawing Figures

10
12
14
16
18
20
21
22
23
24
25
26
27
28
30
32
33
34
35
36
37
38
40
41
43
44
45
48
49
52
54
55
56
57
58
60
62
64

10
14
16
18
21
22
23
26
27
34
35
38
40
41
44
45
49
52

10
20
23
25
27
28
35
43
44
45
48
49
52

MAKE UP AIR SYSTEM

SUMMARY BACKGROUND OF THE INVENTION

The present invention relates to systems for air cooling fluids used in an industrial process in a plant and for providing heated, make up air to that plant.

There are many plants that perform industrial operations in which a fluid, oil for example, is utilized for quenching, i.e. heat treatment; at the same time the plant may very well be utilizing a significant amount of oxygen in the plant for combustion purposes. In such facilities the quenching fluid may be reused but first must be cooled to the selected temperature for the quenching process. At the same time make up air must be provided to replace the oxygen used in combustion. Even if the oxygen used in combustion were minimal, fresh air would be desirable to replenish the stale air in the plant. Where the plant is located in a region which has a relatively cold climate, the make up air introduced into the plant must be heated. The present invention provides apparatus for air cooling the fluid which has been heated through processing and at the same time utilizing the air, the temperature of which has now been raised, as a source of heated, make up air for the plant. In the present invention the temperature of the make up air is raised within a desired temperature range.

Therefore it is an object of the present invention to provide a novel apparatus for providing heated make up air to a plant.

It is another object to provide novel apparatus for air cooling a fluid used in a plant in an industrial process and utilizing the now heated air as a make up air for the plant.

It is another object to provide novel apparatus of the above described type in which the apparatus can be controlled or modulated to provide heated make up air within a desired temperature range while cooling the liquid to a preselected temperature.

Other objects, features, and advantages of the present invention will become apparent from the subsequent description and the appended claims, taken in conjunction with the accompanying drawings, in which:

Figure 1:
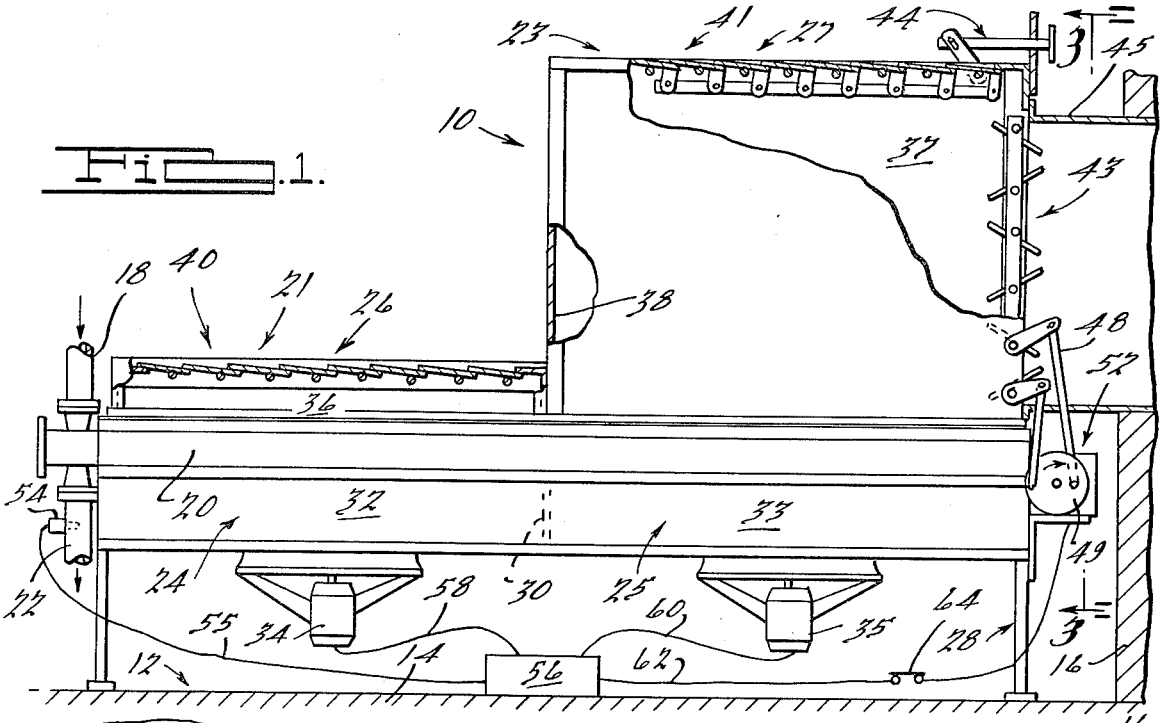
FIG. 1 is a front elevational view of apparatus embodying features of the present invention shown located at a plant.
Figure 2:
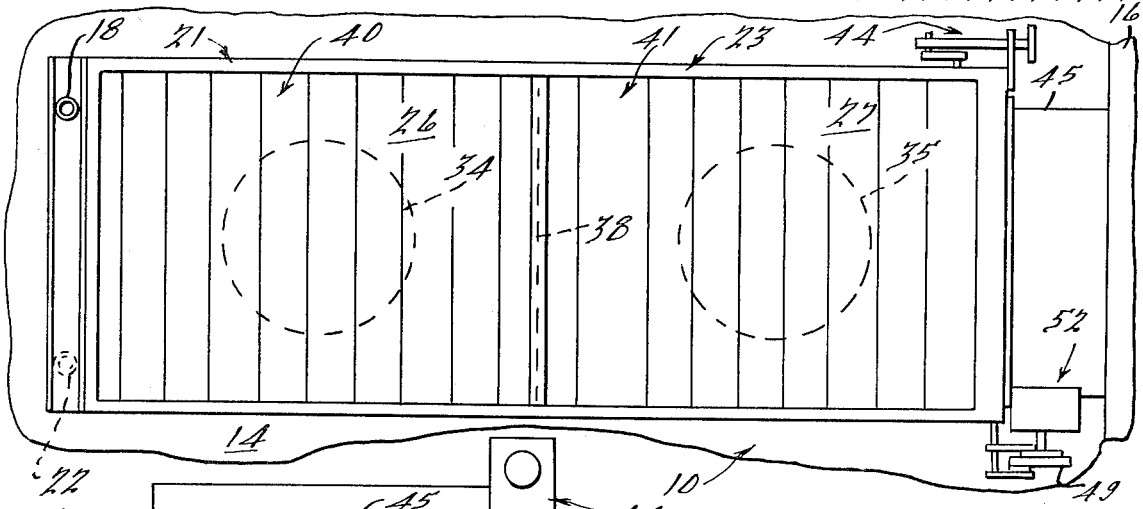
FIG. 2 is a plan view of the apparatus of FIG. 1.
Figure 3:
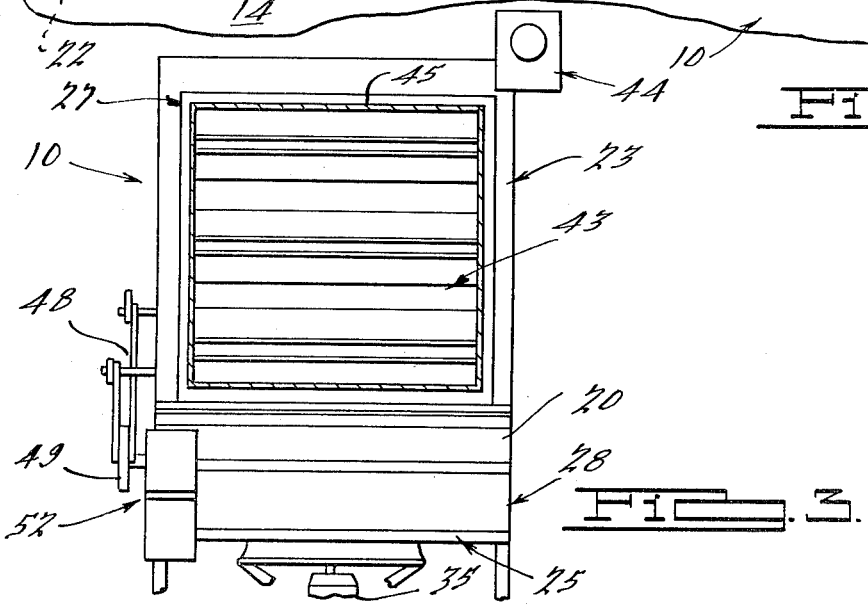
FIG. 3 is a side elevational view of the apparatus of FIG. 1 taken in the direction of the arrows 3—3 in FIG. 1.

Looking now to FIG. 1 a cooling assembly 10 is shown mounted exteriorly of a building 12 for an industrial plant. In the drawings, the cooling assembly 10 is depicted as mounted on a roof 14 of the building 12 and adjacent to the exterior of a side wall 16 (only partially shown).

A primary function of the cooling assembly 10 is to cool a fluid such as oil which is being used in an industrial process. It should be noted that the temperature from which the fluid is to be cooled is predictable and the desired temperature to which it is to be cooled is known. The heated fluid is received by an inlet pipe 18, and is transmitted to a tube bundle 20 which is comprised of a series of horizontally spaced parallely extending tubes running back and forth for the length of the assembly 10. The tube bundle 20 resembles a radiator structure and can include cooling fins to enhance heat transfer. As the fluid is circulated through the tube bundle 20 it is cooled and the cooled fluid is removed via an outlet tube 22 for return for use in the industrial process. The tube bundle 20 is operatively connected with and is cooled by air flow via a pair of air flow sections 21 and 23. As will be seen air flow through section 21 is operated solely in an 'on-off' fashion while the air flow through section 23 is variably controlled.

Thus the tube bundle 20 is supported between a pair of intake sections 24 and 25 and an associated pair of outlet sections 26 and 27. Intake section 24 and outlet section 26 are parts of air flow section 21 while intake section 25 and outlet section 27 are parts of air flow section 23. The intake sections 24 and 25 are supported upon a lower support structure 28 located on the roof 14 and are separated by a lower divider 30 whereby substantially separated lower plenum chambers 32 and 33 are defined. Fan assemblies 34 and 35 are mounted in intake sections 24 and 25, respectively, and are adapted, when actuated, to force air upwardly into plenums 32 and 33 and across the tube bundle 20 to cool the fluid in the tube bundle 20. Vertically opposite the intake sections 24 and 25 are the corresponding outlet sections 26 and 27 with the outlet sections 26 and 27 defining upper plenum chambers 36 and 37. The plenum chambers 36 and 37 are separated from each other via an upper divider 38.

The upper plenum chamber 36 of air flow section 21 is enclosed on its sides and has a louver assembly 40 covering its top. The louver assembly 40 is of a static type construction with the louvers counterbalanced to be normally closed but which will be forced open by the air pressure generated by fan assembly 34 when it is actuated. The upper plenum chamber 37 of air flow section 23 is also enclosed but has a louver assembly 41 located on its top. Louver assembly 41 can be selectively actuable via lever assembly 44 to either an open or closed position. The upper plenum chamber 37 also has a side louver assembly 43 which is controllably driven to various positions from completely open to completely closed whereby the volume of air flow therethrough can be modulated.

Note that while the top louvers 40 and 41 communicate the upper plenums 36 and 37 to the atmosphere, the side louvers 43 are connected to the make up air system of the building 12 via a duct 45. While the top louvers 40 and 41 are parallel action type, the side louvers 43 are opposed action to facilitate control of air flow.

The side louvers 43 are connected by a linkage 48 to a drive mechanism 52. The drive mechanism 52 can comprise a reversible electric motor and gear reduction arrangement for actuating the linkage 48, which can include a crank member 49, for moving the louvers 43 to positions from open to closed.

While the cooling assembly 10 can function to provide make up air to the interior of the building 12 at a raised temperature, its primary function is to cool the liquid in the tube bundle 20. To this end a sensor 54 is located in the fluid outlet or return line 22 and senses the temperature of the cooled fluid. The sensor 54 can be a thermocouple or other type temperature sensing device which provides an electrical signal which varies in accordance with variations in the sensed temperature. The temperature signal is transmitted via a line 55 to a control unit 56 which controls the fan assemblies 34 and 35 via output lines 58 and 60, respectively, and the drive mechanism 52 for side louvers 43 via line 62.

While heated make up air for the interior of the building 12 is desirable when the outside air temperature is below a known magnitude it is not desired when the air emperature is above such magnitudes. Thus the apparaus will have a 'winter' and a 'summer' mode of operaion. For 'winter' operation i.e. heated make up air lesired, the top louver 41 is closed via mechanism 44. A control switch 64 to the drive mechanism 52 for side ouvers 43 is closed whereby drive mechanism 52 can be controlled by an output signal from control unit 56. In his 'winter' mode of operation, the control unit 56 will ctuate fan assembly 35 when the temperature sensed by ensor 54 exceeds a preselected magnitude. At the same ime the drive mechanism 52 will be actuated to move ide louvers 43 toward its open position. Note then, that he control unit 56 is adapted to respond to an analog voltage signal from sensor 54 which varies with variaions in the fluid temperature and the unit 56 produces bipolar output signal to drive mechanism 52. The olarity of the bipolar signal is determined by the relaionship of the temperature sensed and the preselected nagnitude of that temperature. Thus drive mechanism 52 can be actuated to drive louvers 43 to either opened r closed positions depending upon whether the sensed emperature is above or below the preselected magniude.

Drive mechanism 52 has a preselected gear reduction whereby the opening or closing of the louvers is deayed to minimize hunting. With the side louvers 43 ully opened, if the temperature sensed by sensor 54 continues to rise to a magnitude above the first preseected magnitude then at a slightly higher magnitude, control unit 56 will actuate fan assembly 34 and static ouvers 40 will be fully opened by the air pressure from an assembly 34. Fan assembly 34 will be turned 'on' and off' to maintain the temperature of the fluid at this lightly higher magnitude. If the temperature drops to he first preselected magnitude then fan assembly 34 will be turned 'off' and cooling will be provided by nodulation of the side louvers 43. For 'summer' operaion, control switch 64 is opened, disconnecting drive nechanism 52 from control unit 56 and side louvers 43 re closed and top louvers 41 are opened via mechanism 4. In this condition control unit 56 will still control fan ssembly 34, by 'on-off' operation, for additional coolng as required and fan assembly 35 will still provide the nain cooling effort.

Note that for 'winter' operation no attempt is made to control the temperature of the heated make-up air but ather it is the temperature of the cooling fluid which is controlled and the temperature of the make up air is llowed to fluctuate. Of course, that portion of the make p air received from the present system can be heated urther, in the conventional manner, if necessary. In any vent the amount of energy needed to heat the make up ir for the plant is reduced.

While it will be apparent that the preferred embodinents of the invention disclosed are well calculated to ulfill the objects above stated, it will be appreciated hat the invention is susceptible to modification, variaion and change without departing from the proper cope or fair meaning of the invention.

What is claimed is:

1. In an industrial system associated with a building nd utilizing a process in which the temperature of a cooling fluid is increased in the process and the fluid is ecirculated and is cooled to be reused in the process nd in which make up air is to be brought into the building at a selected temperature, apparatus for cooling the fluid and for providing heated make up air to the building comprising: tube means including cooling tubes located outside the building and circulating the fluid to be cooled, first and second input chambers located on one side of said cooling tubes and adapted to direct air towards said cooling tubes, a fan located in each of said input chambers and being selectively operable for forcing air from the atmosphere over said cooling tubes whereby the fluid is cooled and the temperature of the cooling air is raised, first and second output chambers located on the opposite side of said cooling tubes with said first and second output chambers being associated with said first and second input chambers, respectively, whereby said output chambers receive the heated air after it is forced over said cooling tubes, said first output chamber having a first opening connected with the building and being operable for directing heated make up air from said first output chamber into the building, said second output chamber having a second opening operable for directing the heated air to the atmosphere, control means operatively connected with each of said fan for separately actuating the same in response to the fluid temperature of the fluid being cooled whereby the fluid will be cooled to a desired temperature, said control means operatively connected with said first output chamber and with said fan associated with said first input chamber and being responsive to the temperature of the fluid being cooled for controllably varying the amount of heated make up air directed into the building as a function of the temperature of the fluid being cooled.

2. In an industrial system associated with a building and utilizing a process in which the temperature of a cooling fluid is increased in the process and the fluid is recirculated and is cooled to be reused in the process and in which make up air is to be brought into the building at a selected temperature, apparatus for cooling the fluid and for providing heated make up air to the building comprising: tube means including cooling tubes located outside the building and circulating the fluid to be cooled, first and second input chambers located on one side of said cooling tubes and adapted to direct air towards said cooling tubes, a fan located in each of said input chambers and being selectively operable for forcing air from the atmosphere over said cooling tubes whereby the fluid is cooled and the temperature of the cooling air is raised, first and second output chambers located on the opposite side of said cooling tubes with said first and second output chambers being associated with said first and second input chambers, respectively, whereby said output chambers receive the heated air after it is forced over said cooling tubes, said first output chamber having a variable first opening connected with the building whereby heated make up air can be directed from said first output chamber into the building, said second output chamber having a second opening operable for directing the heated air to the atmosphere, control means operatively connected with each of said fan for separately actuating the same in response to the fluid temperature of the fluid being cooled whereby the fluid will be cooled to a desired temperature, said control means operatively connected with said first variable opening and responsive to the temperature of the fluid being cooled for controllably varying said first opening whereby the amount of heated make up air directed into the building will be varied as a function of the temperature of the fluid being cooled.

3. The system of claim 2 with said control means increasing the opening of said first opening when the fluid temperature exceeds a first preselected temperature and energizing said fan associated with said second chamber when the fluid temperature exceeds a second preselected temperature.

4. The system of claim 3 including a third opening connected with said first output chamber and being selectively actuable for directing the heated air to the atmosphere, said control means including disabling means for disabling actuation of said first variable opening such that with said first variable opening closed and said third opening being open the heated air will be directed away from the interior of the building and into the atmosphere.

5. The system of claim 4 with said second opening being normally closed and being opened in response to actuation of said fan associated with said second chamber.

6. The apparatus of claim 5 with said first variable opening being defined by movable louvered structures.

* * * * *